United States Patent [19]

Klimaschka et al.

[11] Patent Number: 4,915,307

[45] Date of Patent: Apr. 10, 1990

[54] MILL, IN PARTICULAR AGITATING MILL

[75] Inventors: Norbert Klimaschka; Wolfgang Schmidt, both of Selb; Udo Enderle, Marktredwitz, all of Fed. Rep. of Germany

[73] Assignee: Erich Netzsch GmbH & Co. Holding Kg, Fed. Rep. of Germany

[21] Appl. No.: 219,327

[22] Filed: Jul. 14, 1988

[30] Foreign Application Priority Data

Jul. 16, 1987 [DE] Fed. Rep. of Germany ..... 3723558

[51] Int. Cl.[4] ..... B02C 17/16

[52] U.S. Cl. ..... 241/65; 241/172; 241/179

[58] Field of Search ..... 241/172, 65, 66, 67, 241/176, 184, 299, 300

[56] References Cited

U.S. PATENT DOCUMENTS

| | | | |
|---|---|---|---|
| 851,637 | 4/1907 | Abbe | 241/182 |
| 1,468,893 | 9/1923 | Wolever | 241/182 |
| 2,204,582 | 6/1940 | Donahue | 241/184 X |
| 4,174,074 | 11/1979 | Geiger | 241/67 X |

FOREIGN PATENT DOCUMENTS

| | | | |
|---|---|---|---|
| 2931868 | 4/1982 | Fed. Rep. of Germany | 241/182 |
| 104658 | 8/1980 | Japan | 241/172 |
| 04526 | 8/1986 | PCT Int'l Appl. . | |
| 383461 | 8/1973 | U.S.S.R. | 241/182 |
| 391855 | 12/1973 | U.S.S.R. | 241/183 |

OTHER PUBLICATIONS

Modernized Ceramic Ballmills, *Glass and Ceramics,* vol. 37, 5–81.

*Primary Examiner*—Mark Rosenbaum
*Attorney, Agent, or Firm*—Michael N. Meller

[57] ABSTRACT

The inner wall of a grinding container (10) is made up of a plurality of ceramic rings (20; 46) which are held together by an enclsure (12). The ceramic rings (20; 46) may be made from case to case of a ceramic material, for example silicon nitride, adapted to the material to be ground and installed in the grinding container (10). They may comprise at their end faces (22, 24) interengaging profiles and/or be adhered together at their end faces (22, 24).

16 Claims, 4 Drawing Sheets

MILL, IN PARTICULAR AGITATING MILL

Figure 1:
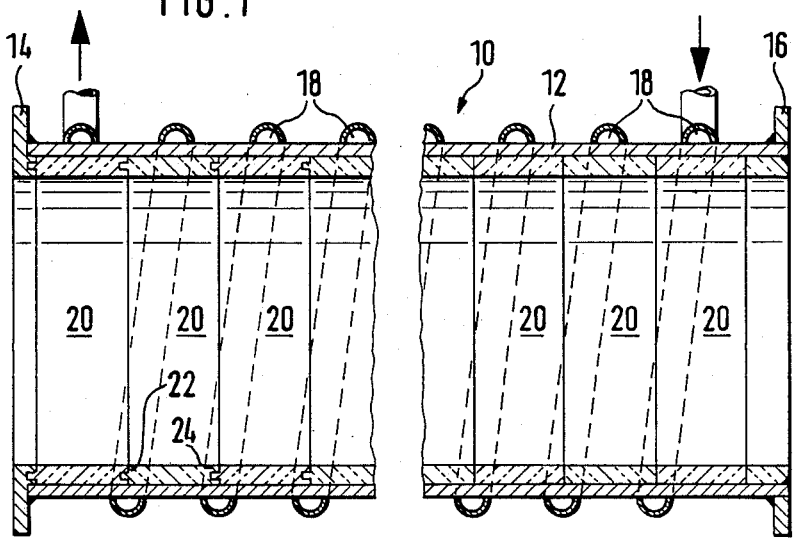

The invention relates to a mill, in particular agitating mill, comprising a grinding container having an inner wall of abrasive-resistant material.

In the grinding art the principle of autogenous grinding has been known for a long time. On this principle, the material to be ground, which is to be kept free from impurities, is processed in a mill whose parts which come into contact with the material ground consist of a material corresponding as largely as possible to the material to be ground. Autogenous grinding has become of particular significance in the production of starting material for highperformance ceramics. The finer and purer the pulverulent starting material is ground and the more homogeneous it can be mixed with the binding aids for the shaping then as a rule the stronger the end product. Even microscopically small foreign bodies in components of high-performance ceramics can cause breakage.

In mills having a container of steel or other material to avoid the material being ground contacting said metal it is usual to make up the linings of individual segment-like bricks or blocks. Such linings can be made only with gaps of a greater or lesser width which must be filled with a binder, for example mortar, and are usually more prone to wear than the bricks themselves. Such linings or masonry are usual in particular in ball mills up to the greatest dimensions which occur. On the other hand, for crushing materials to powders it has been usual since antiquity to employ one-piece mortars of natural stone or porcelain.

For mills of medium size, in particular agitating mills, whose grinding containers cannot be made in one piece from abrasive-resistant material, in particular high-strength ceramics, so far no lining has been available which can be made from a material adapted to the material to be ground and can be installed from case to case corresponding to the material to be ground and is largely wear-resistant. The invention is therefore based on the problem of providing a mill having such a lining.

Proceeding from a mill of the type mentioned at the beginning the problem is solved according to the invention in that the inner wall is made up of a plurality of ceramic rings which are held together by an enclosure.

Ceramic rings can be made in all practically occurring sizes and the usual production methods of turning or casting can be employed. Such rings may be made with an axial length of the order of magnitude of 2 to 6 times, preferably 3 to 5 times, their thickness and burnt without distorting in troublesome manner, let alone breaking. Depending on the particular case an inner wall of a greater or lesser length for a grinding container may be made from any desired number of such rings.

The ceramic rings consist preferably of silicon nitride. Depending on the nature of the material to be ground in the mill however other nitrides are also suitable, in particular aluminium nitride, titanium nitride, zirconium nitride, yttrium nitride, magnesium nitride, beryllium nitride and hexagonal or cubic boron nitride. For other uses certain carbides are particularly suitable, for example silicon carbide, boron carbide, titanium carbide, tantalum carbide, tungsten carbide and polycrystalline diamond. The ceramic rings may however also be mixed ceramics consisting of oxidic and non-oxidic compositions.

The individual ceramic rings may have plane end faces abutting flat against each other. It is however expedient for the ceramic rings to have at their end faces interengaging profiles; for example, suitable profiles are profiles of the nature of groove and tongue joints and conical profiles. By such profiles the ceramic rings are centered with respect to each other and joined together to form an inner wall which can be subjected to high static and dynamic loads.

The loadbearing ability of the connection between the individual ceramic rings can be further increased by adhering the ceramic rings together at their end sides.

It is further advantageous for the ceramic rings to have at least one radially outwardly projecting flange on which the enclosure bears. In this manner the ceramic rings can be stiffened so that they need only have a small wall thickness. The small wall thickness improves the ability of the ceramic rings to dissipate to the outside the heat generated in the mill.

It is accordingly particularly expedient to form coolant passages between the flanges.

The enclosure may be a metal tube or consist of individual rings, preferably of metal, or be a helical band which preferably also consists of metal.

If the enclosure is a helical band then the latter itself expediently forms a coolant passage.

In all the cases mentioned the enclosure may be shrunk onto the ceramic rings to subject the rings to circumferential compressive forces.

In agitating mills it is usual to secure to the inner wall of the grinding container rods which extend radially inwardly. Such rods may consist fundamentally also of ceramic material or be lined with such material. It is however more expedient if in accordance with a further development of the invention some of the ceramic rings of the inner wall of the grinding container comprise integrally formed radially inwardly extending projections.

A ceramic ring with smooth inner side can be disposed axially between every two ceramic rings having radially inwardly extending projections.

In a further development of the invention within the grinding container an agitating shaft having an outer wall made up of ceramic rings is disposed.

It is expedient for an outwardly smooth ceramic ring of the agitating shaft to be disposed radially opposite each ceramic ring of the inner wall of the grinding container provided with projections and a ceramic ring of the outer wall of the agitating shaft provided with integrally formed radially outwardly extending projections to be disposed radially opposite each ceramic ring of the inner wall of the grinding container smooth at its inner side.

The ceramic rings of the agitating shaft are preferably fitted on a metal core and held by the latter clamped together in the axial direction.

Finally, it is expedient for the projections of said inner wall of the grinding container and/or of the outer wall of the agitating shaft to be approximately trapezoidal in axial and radial cross-section.

Figure 5:
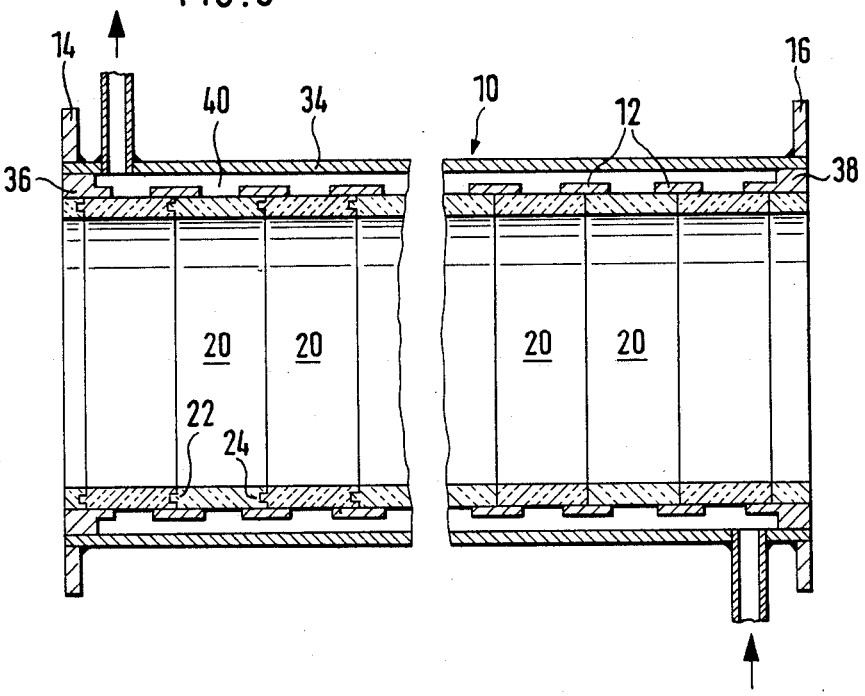
Figure 6:
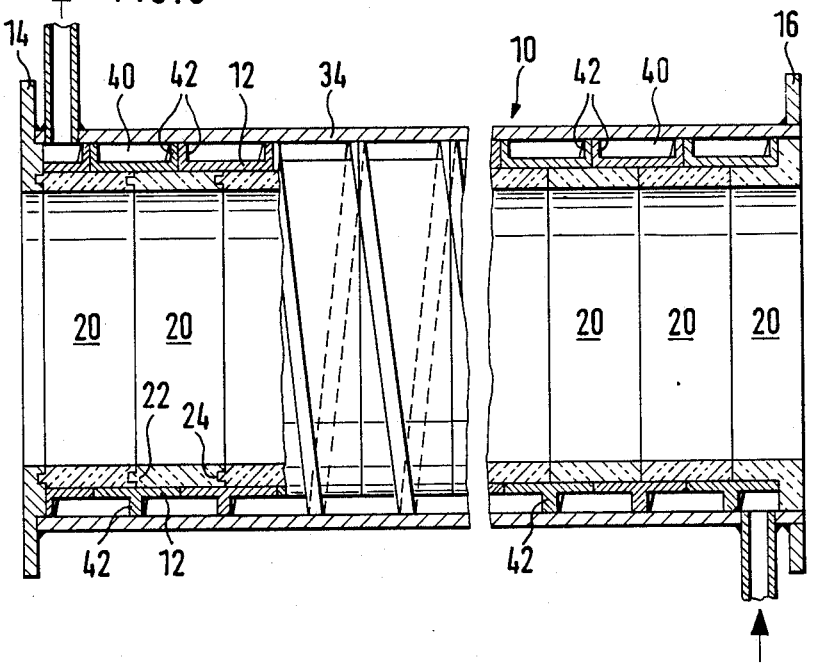
Figure 7:
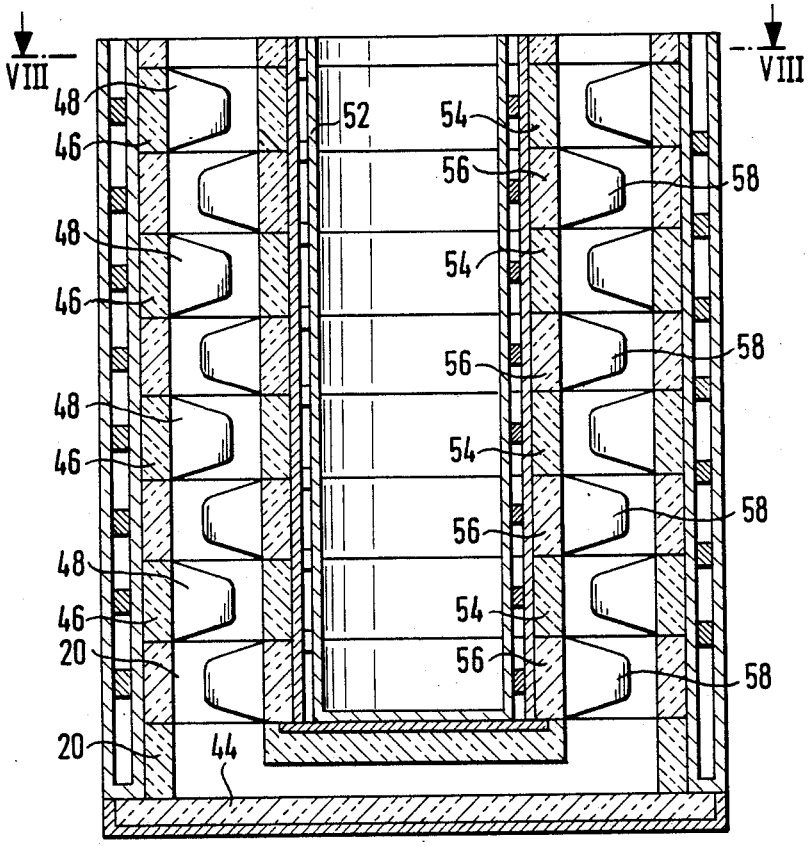
Figure 8:
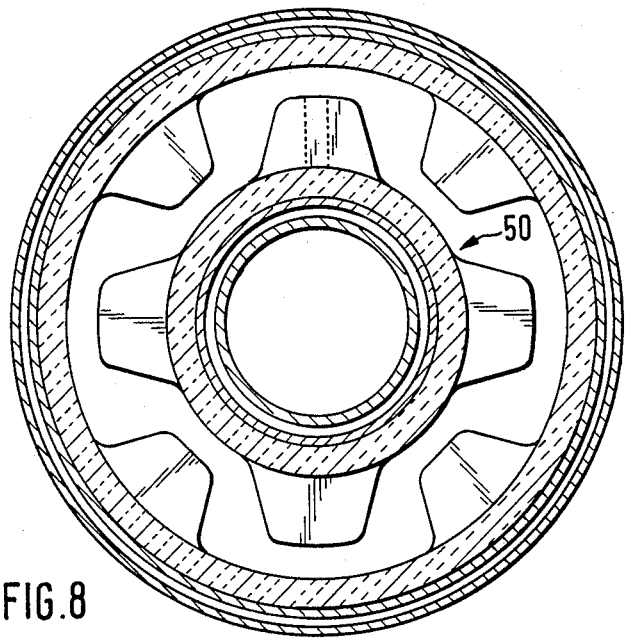

Examples of embodiment of the invention will be explained in more detail hereinafter with the aid of schematic drawings, wherein:

FIGS. 1 to 6 show various examples of embodiment of a grinding container for an agitating mill, in each case in an axial section, and FIGS. 7 and 8 show a grinding container and agitator of an agitating mill in an axial section and in radial section VIII—VII of FIG. 7.

FIG. 1 shows a grinding container 10 which comprises an enclosure 12 in the form of an inwardly smooth cylindrical steel tube. Welded to each of the two end sides of said enclosure 12 is an annular flange 14 and 16 respectively. Wound round the outer surface of the enclosure 12 is a coolant conduit 18 in the form of a semicircular metal tube which is likewise welded or soldered on.

The grinding container 10 comprises an inner wall which is made up of a plurality of ceramic rings 20. The latter consist for example of silicon nitride and are place tightly against each other at the end sides. The ends sides of the ceramic rings 20 may be planar as shown in the right part of FIG. 1 so that the ceramic rings abut flat against each other. In this case it is particularly expedient for the ceramic rings 20 to be adhered together at their end faces.

Alternatively, the ceramic rings 20 may have end sides 22 and 24 which are profiled complementary to each other. As an example of such a configuration in the left part of FIG. 1 ceramic rings 20 are shown which each have a left end face 22 provided with a rib profile and a right end face 24 grooved complementary thereto. Adjacent ceramic rings 20 with end faces 22 and 24 formed in this manner interengage like tongue and groove profiles.

Figure 2:
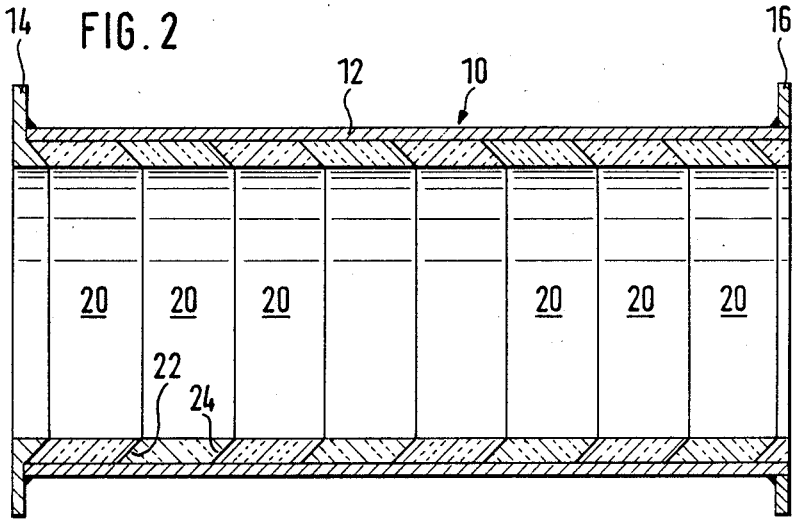

Another possibility for interengagement of the end faces of the ceramic rings 20 is shown in FIG. 2; in this case the ceramic rings 20 each have a hollow conical end face 22 and a corresponding conical end face 24.

In the embodiments illustrated in FIGS. 1 and 2 the enclosure 12 is shrunk onto the ceramic rings 20 joined together in the manner described so that the cylindrical outer faces of the ceramic rings 20 are subjected to circumferential compressive forces and bear completely on the enclosure 12.

Figure 3:
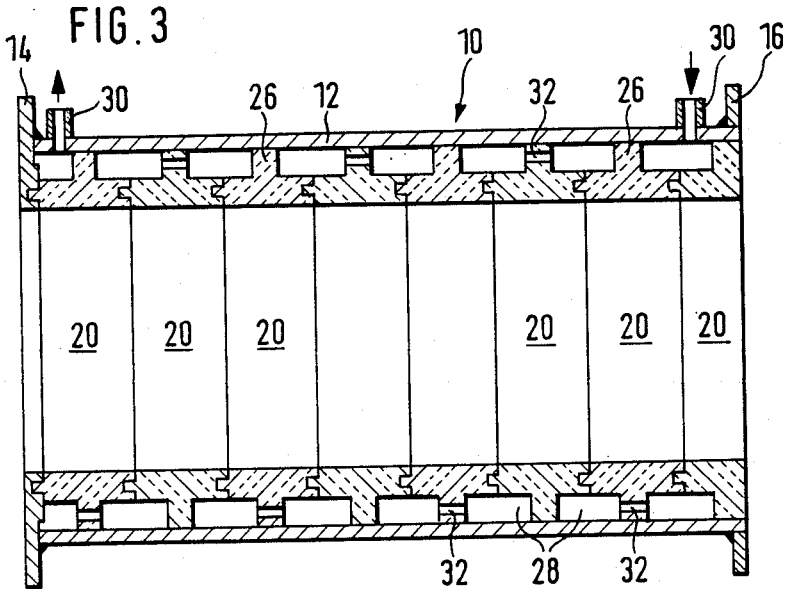
Figure 4:
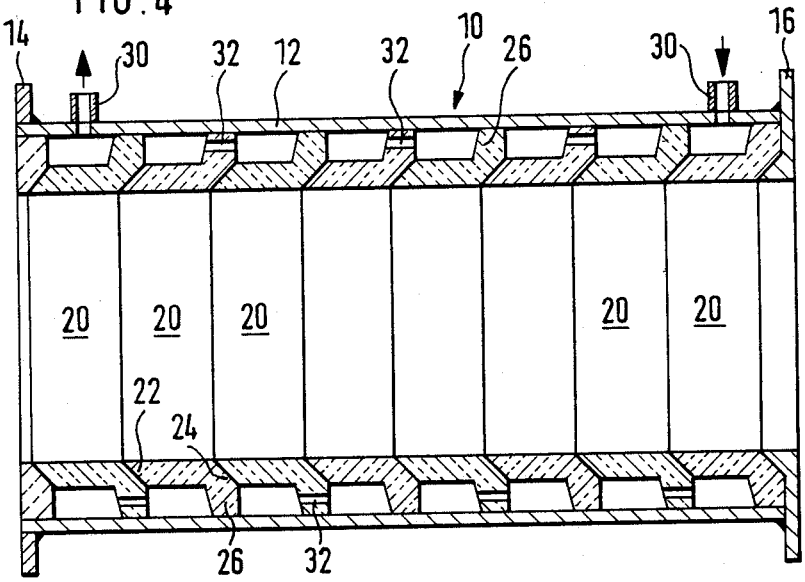

The embodiments illustrated in FIGS. 3 and 4 correspond as regards the configuration of the enclosure 12 as cylindrical tube and also as regards the configuration of the end faces 22 and 24 to the embodiment illustrated in FIG. 1 or FIG. 2. A difference in FIGS. 3 and 4 compared with FIGS. 1 and 2 is that each individual ceramic ring comprises a radially outwardly projecting annular flange 26 onto the outer surface of which the enclosure 12 is shrunk.

In accordance with FIG. 3 the flanges 26 are each disposed in a centre region of the associated ceramic ring 22 whilst according to FIG. 4 the flanges 26 are each arranged at an end of the associated ceramic ring 20. In both embodiments illustrated in FIGS. 3 and 4 between the flanges 26 of adjacent ceramic rings an annular coolant passage 28 is left free. The coolant passages 28 may be combined to form an uninterrupted coolant passage 30, for example by providing each flange 26 with an axis-parallel cutout 32 and arranging the ceramic rings 20 in such a manner that the cutouts 32 of adjacent ceramic rings are offset with respect to each other by 180°.

In the embodiment illustrated in FIG. 5 the enclosure 12 consists of rings of flat rectangular cross-section each covering a joint between adjacent ceramic rings 20. This enclosure 12 can also be secured by shrinking on; alternatively, the rings which form the enclosure 12 can be clamped with turn buckles of known type. In either form of construction, the rings are subjected to circumferential compressive forces. According to FIG. 5 the ceramic rings 20 and the enclosure 12 are surrounded by an outer cylindrical shell 34 of steel which bears closely at each of its two ends on a thickened ring 36 and 38 belonging to the enclosure 12 so that it surrounds a tubular coolant passage 40.

In FIG. 6 a modification of FIG. 5 is shown in which the enclosure 12 is formed by a profiled metal band wound helically around the ceramic rings 12. In the upper half of FIG. 6 an embodiment is shown in which the coiled enclosure 12 has a U-shaped profile; in the lower half of FIG. 6 the coiled enclosure 12 has however a T-shaped profile. In both cases webs 42 of said profile bear closely on the outer surface 34 so that they form a helical coolant passage 40 corresponding to the helical configuration of the enclosure or shell 12.

In FIGS. 7 and 8 an agitating mill is shown having a grinding container 10 comprising ceramic rings 20 substantially in the configuration and arrangement corresponding to the right part of FIG. 1. The ceramic rings 20 are cylindrical on the inside. One of said ceramic rings 20 tightly adjoins a bottom plate 44 which consists of the same ceramic material as the ceramic rings 20. On the lowermost ceramic ring 20 there is a ceramic ring 20 of the same shape and size, i.e. also having a smooth inner surface. Disposed thereover is a ceramic ring 46 which comprises at its inner side radially inwardly extending projections 48. The projections 48 are formed integrally with the ceramic ring 46 and have a trapezoidal form in axial cross-section according to FIG. 7 as well as in radial cross-section according to FIG. 8. On the ceramic ring 46 there is again a ceramic ring 20 which is smooth on the inside; thereabove there is a further ceramic ring 46 provided with projections 48, etc.

Inside the grinding container 10 an agitating shaft 50 is provided which comprises a double-walled tubular metal core 52 and ceramic rings 54 and 56 mounted thereon. Every other ceramic ring 54 is smooth on the outside and enclosed by ceramic rings 46 provided with projections 48. The remaining ceramic rings 56 are provided at the outside with projections 58 which extend radially outwardly in the direction towards a smooth ceramic ring 20 of the grinding container 10 surrounding the respective ceramic ring 56.

We claim:

1. A grinding container for a mill comprising
an inner tubular wall of abrasion-resistant material,
an outer tubular wall surrounding said inner wall,
and a coolant passage formed between said inner and outer walls,
said inner tubular wall being made up of a plurality of ceramic rings which have interengaging end faces, said coolant passage being separated from said interengaging end faces by an enclosure tightly enclosing at least the end portions of each pair of adjoining ceramic rings,
wherein at least the end portions of said ceramic rings are subjected to circumferential compressive forces by said enclosure.

2. A grinding container according to claim 1, characterized in that the ceramic rings (20; 46) consist of silicon nitride.

3. A grinding container according to claim 1, characterized in that the ceramic rings (20; 46) are mixed ceramics consisting of oxidic and non-oxidic compositions.

4. A grinding container according to claim 1, characterized in that the ceramic rings (20) have interengaging profiles at their end faces (22, 24).

5. A grinding container according to claim 1, characterized in that the ceramic rings (20; 46) are adhered together at their end faces (22, 24).

6. A grinding container according to claim 1, characterized in that the enclosure (12) is a metal tube.

7. A grinding container according to claim 6, characterized in that the enclosure (12) is shrunk onto the ceramic rings (20).

8. A grinding container according to claim 1, characterized in that the enclosure (12) consists of individual rings.

9. A grinding container according to claim 1, characterized in that the enclosure (12) is a helical band.

10. A grinding container according to claim 9, characterized in that the band forms a coolant passage (30).

11. A grinding container according to claim 1, characterized in that some of the ceramic rings (46) of the inner wall of the grinding container (10) comprise integrally formed radially inwardly extending projections (48).

12. A grinding container according to claim 11, characterized in that the projections (48, 58) are approximately trapezoidal in axial and in radial cross-section.

13. A grinding container according to claim 11, characterized in that a ceramic ring (20) having a smooth inner side is disposed axially between every two ceramic rings (46) having radially inwardly extending projections (48).

14. A grinding container according to claim 1, characterized in that inside the grinding container (10) an agitating shaft (50) with an outer wall made up of ceramic rings (54, 56) is arranged.

15. A grinding container according to claim 14, characterized in that an outwardly smooth ceramic ring (54) of the agitating shaft (50) is disposed radially opposite each ceramic ring (46) of the inner wall of the grinding container (10) provided with projections (48), and a ceramic ring (56) of the outer wall of the agitating shaft (50) provided with integrally formed radially outwardly extending projections (58) is disposed radially opposite each ceramic ring (20) of the inner wall of the metal container (10) smooth at its inner side.

16. A grinding container according to claim 14, characterized in that the ceramic rings (54, 56) of the agitating shaft (50) are fitted onto a metal core (52) and held by the latter clamped together in the axial direction.

* * * * *